United States Patent [19]

Klenk

[11] Patent Number: 4,832,109

[45] Date of Patent: May 23, 1989

[54] METHOD AND APPARATUS FOR DAMPING PRESSURE PEAKS OCCURRING AT THE END OF THE MOLD FILLING PHASE IN PRESSURE CASTERS

[75] Inventor: Walter Klenk, Baindt, Fed. Rep. of Germany

[73] Assignee: Maschinenfabrik Müller-Weingarten AG, Weingarten, Fed. Rep. of Germany

[21] Appl. No.: 100,384

[22] Filed: Sep. 24, 1987

[30] Foreign Application Priority Data

Sep. 27, 1986 [DE] Fed. Rep. of Germany ..... 3632925

[51] Int. Cl.[4] ..... B22D 17/10

[52] U.S. Cl. ..... 164/312; 188/312

[58] Field of Search ..... 164/312, 313, 314, 315, 164/316, 317, 318; 425/557, 567; 188/312, 322.15

[56] References Cited

FOREIGN PATENT DOCUMENTS 3433121 12/1985 Fed. Rep. of Germany ..... 164/314

*Primary Examiner*—Kuang Y. Lin

*Attorney, Agent, or Firm*—Spencer & Frank

[57] ABSTRACT

The invention relates to a method of damping the pressure peak occurring at the end of the die filling phase in die casting machines, with a hydraulic damping device being disposed between the piston rod of the drive piston and the piston rod of the casting piston. The damping chamber of the damping device is closed by a control piston through which no fluid flows in the case of damping and which is not required to move against the direction of movement of the casting piston rod in order to open the control edge. It is here the object of the invention to shorten to a minimum the response time of the control piston. According to the invention, a device is proposed for this purpose which is characterized in that the chamber (25) disposed on the side opposite the reservoir chamber (10) of the control piston (4) is connected to a pressure medium conduit (26) in which a control valve (27) is disposed. It is here of advantage that a preselectable excess pressure, a vacuum, but preferably atmospheric pressure, is connected to the "T" terminal of the so-called return flow conduit (28) of the control valve (27).

5 Claims, 3 Drawing Sheets

METHOD AND APPARATUS FOR DAMPING PRESSURE PEAKS OCCURRING AT THE END OF THE MOLD FILLING PHASE IN PRESSURE CASTERS

BACKGROUND OF THE INVENTION

The invention relates to a method and an apparatus for damping the pressure peak occurring at the end of the die filling phase in die casting machines. The apparatus includes a hydraulic damping device disposed between the piston rod of the drive piston and the piston rod of the casting piston. The damping chamber of the damping device is bounded by a control piston through which no fluid flows when damping takes place and which is not required to move against the direction of movement of the casting piston rod in order to open a control port with its control edge.

The die casting process involves essentially three operating phases. During the first operating phase, the pressing plunger proper initiates the pressing process at a relatively slow speed, thus enabling the air still contained in the injection cylinder to escape. In the second operating phase, in which the pressing plunger moves further at an increased speed, the liquid metal is pressed into the die. In the subsequent third operating phase, the metal is compressed in the die by a so-called dwell pressure.

The present invention essentially relates to the second operating phase, at the end of which the pressing plunger and its piston rod are suddenly braked to a zero speed. This generates in the metal a pressure peak which may overcome the die closing force proper, and thus a brief opening of the die cannot be excluded.

To prevent such an undesired die opening, high closing forces are used which would actually not be necessary at the end of the second operating phase if the pressure peak were avoided.

A measurement of the pressure peak by means of appropriate devices shows that in reality there are two pressure peaks. The first pressure peak occurs immediately at the end of the rapid die filling process and is only due to the sudden braking of the moving masses including the casting piston rod, the coupling and the plunger rod. After about 1 to 2 milliseconds, a hydraulic pressure peak follows as a result of the moving oil column being braked. The intensity of the first pressure peak can be measured only in the die or by a comparable measuring device while the second pressure peak is measured as usual in the drive chamber of the pressing system.

If the casting operation is performed without, the casting piston is braked within 1 to 2 milliseconds, dependent from the volume to be cast and the state of the die-casting mold, from its charging speed to a standstill.

To make the transition as smooth as possible, the switching process must thus last less than one millisecond. The greater the switching delay, the greater the reduction in speed and thus the magnitude of the pressure peak. -

A further factor contributing to the magnitude of the pressure peak is the pressure captured in the damping chamber. In a system in which the pressure in the damping chamber opens the control valve against a spring force, the biasing force of the spring must be higher, i .e. the maximum operating and acceleration pressure in the die filling phase. Accordingly, at the end of die filling, the control pressure is first increased and only if the spring force has been exceeded to an appropriate degree, is the control valve switched. This results in the loss of valuable time. Furthermore, the control pressure must be added to the pressure peak of the kinetic energy since the movement of the control piston begins only after this switching period.

German patent document 2,818,061 discloses a damping device of the abovedescribed configuration.

In this device too, a damping chamber is controlled by a spring-charged control piston which is likewise disposed in the direction of movement of the casting piston rod. This control is designed in such a manner that the control valve operates as a pressure valve and the mass of the control valve is intentionally maintained at a small value.

This prior art construction has the following drawbacks:

(a) the opening force of the control valve must be higher than the transfer force of the piston rod in the die filling phase;

(b) fluid passes through the control valve, i.e. the hydraulic medium present on the spring side of the control valve must be displaced; this influences the response time of the control valve;

(c) the reservoir chamber of the damping device is, due to its structure, smaller than the displaced volume so that an additional reservoir space must be provided.

It is also known (German Patent No. 2,833,063) to equip the casting piston with hydraulic damping means. In this case, the casting piston rod is displaceably mounted in a hollow casting piston. A piston antechamber then accommodates a hydraulic medium which serves as damping and cooling means.

Each piston configuration requires a correspondingly adapted damping device.

Since the piston is a part that is subject to wear, higher operating costs inevitably result upon replacement, since a piston equipped with a damping device is considerably more expensive than a simple casting piston. Sealing problems also result since the casting piston is subjected to very large differences in temperature.

During damping, the control piston responsible for the response time of the damping device must be accelerated against its direction of movement during the die filling process and against the spring force which is set to correspond to the maximum operating pressure in the damping chamber and must be moved over a relatively long path.

German patent document 3,433,121 discloses a device which corresponds to the embodiment now being presented, except that it also includes a spring-charged control piston. The drawback of this device is that the force exerted by the decelerated mass of the control piston is in part consumed by the pretensioned spring force and thus, for lower die filling speeds, the response times are correspondingly longer.

SUMMARY OF THE INVENTION

It is an object of the invention to provide an improved method and apparatus of the above-outlined type which reduce the response time of the control valve to a minimum.

This is accomplished according to the invention, according to which, briefly stated, the force generated to close the control port by the control piston is reduced during damping.

It is an advantage of the invention that the force required to close the control port by the control piston is generated by use of a hydraulic medium or gas, preferably compressed air, and is reduced again when the control port is closed.

The specific structure of the respective device for implementing the method is characterized in that the chamber disposed on the side of the control piston opposite the reservoir chamber, is connected with a pressure medium conduit in which a control valve is disposed.

According to a further feature of the invention, pressure, a vacuum, but preferably atmospheric pressure, is applied to the "T" terminal of the return conduit of the control valve.

According to the invention, at the end of the die filling process the control piston is moving at the die filling speed, while the damping piston containing the control port - has stopped or is braked considerably. Since the the control piston only minimally covers the control port and the switching stroke for the release of the damping device is about 1 mm, and no counterforce or only a slight counterforce affects the control piston, the response time, due to the high casting piston speed, is only a fraction of a millisecond. The increase in pressure in the damping chamber need not be added to the charging pressure peak since the switching process is initiated immediately at the end of the die filling phase. After the damping process, the valve is actuated with the command "return the plunger" until the control port is closed again by the control edge of the control piston.

DESCRIPTION OF THE PREFERRED EMBODIMENT

Figure 1:
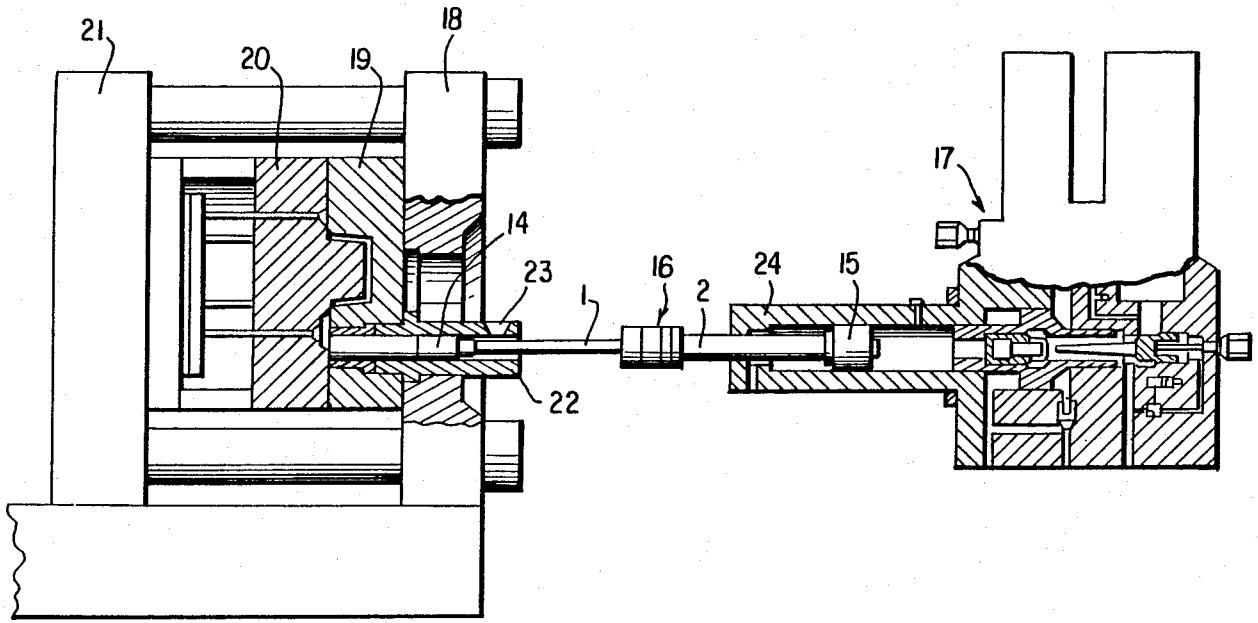
FIG. 1 is a schematic longitudinal sectional view of a a die casting machine incorporating the invention.

Turning to FIG. 1, there is illustrated therein a portion of a die casting machine having a fixed clamping plate 18 with fixed die half 19, a movable clamping plate 21 with movable die half 20, a die casting cylinder 22 with fill opening 23, a casting piston 14 with piston rod 1, a drive 17 with drive cylinder 24, a drive piston 15 with piston rod 2 and a damping device 16 disposed between piston rods 1 and 2.

Figure 2:
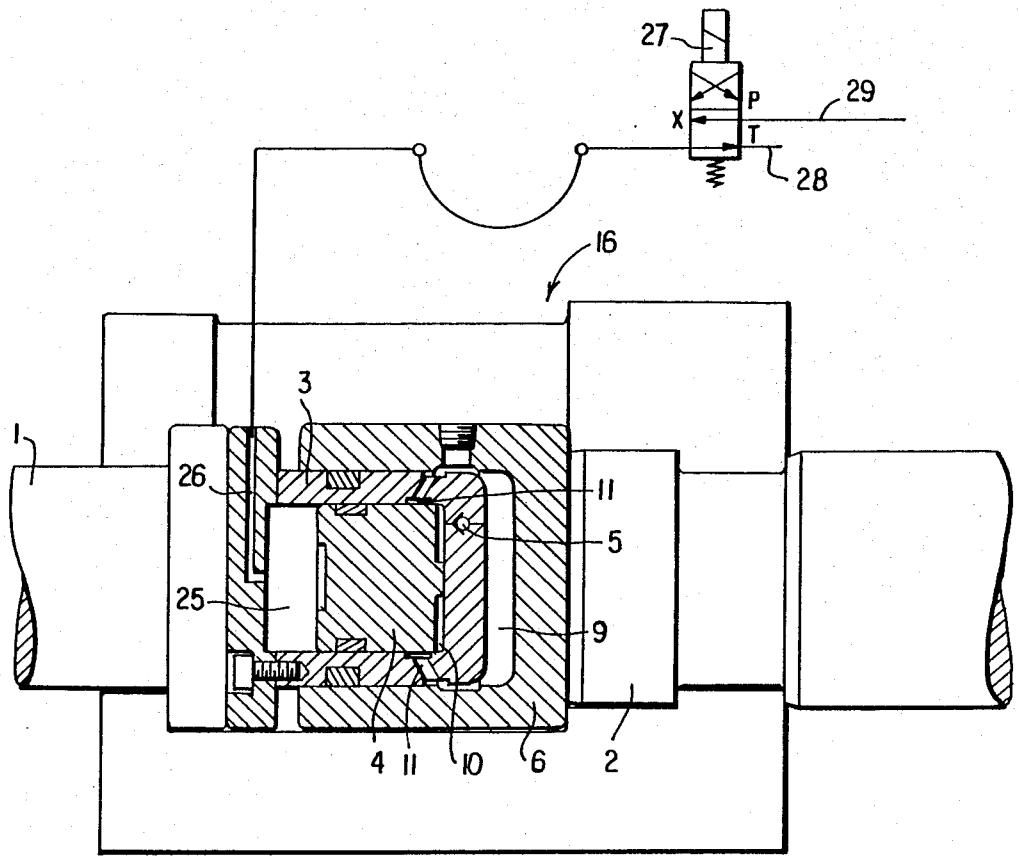
FIG. 2 is an enlarged longitudinal sectional view of a preferred embodiment of the invention depicted during the die filling phase.

FIG. 2 shows the damping device 16 in the starting position and during the die filling movement. The control ports 11 formed in the damping piston 3 are entirely covered by the land of the control piston 4 and thus communication is blocked between a damping chamber 9 formed by the housing 6 and the damping piston 3 and a reservoir chamber 10 formed between damping piston 3 and control piston 4. The chamber 25 disposed opposite reservoir chamber 9 at control piston 4 is connected with the atmosphere by way of a connecting line 26, a control valve 27 and a fluid line 28. A check valve 5 provided in the wall of the damping piston 3 is closed. The inertia of control piston 4 reinforces the blocking function of the land of the control piston 4 during the high acceleration for the rapid die filling movement and thus drive piston rod 2 is able to transmit the rod force in a similar form-locking manner to casting piston rod 1.

At the end of the die filling phase, casting piston rod 1 and damping piston 3 are decelerated considerably while control piston 4 continues to move at the die filling speed, opens the control port 11 and initiates the damping, that is, a braked relative axial motion of the drive piston rod 2 towards the casting piston rod 1.

Figure 3:
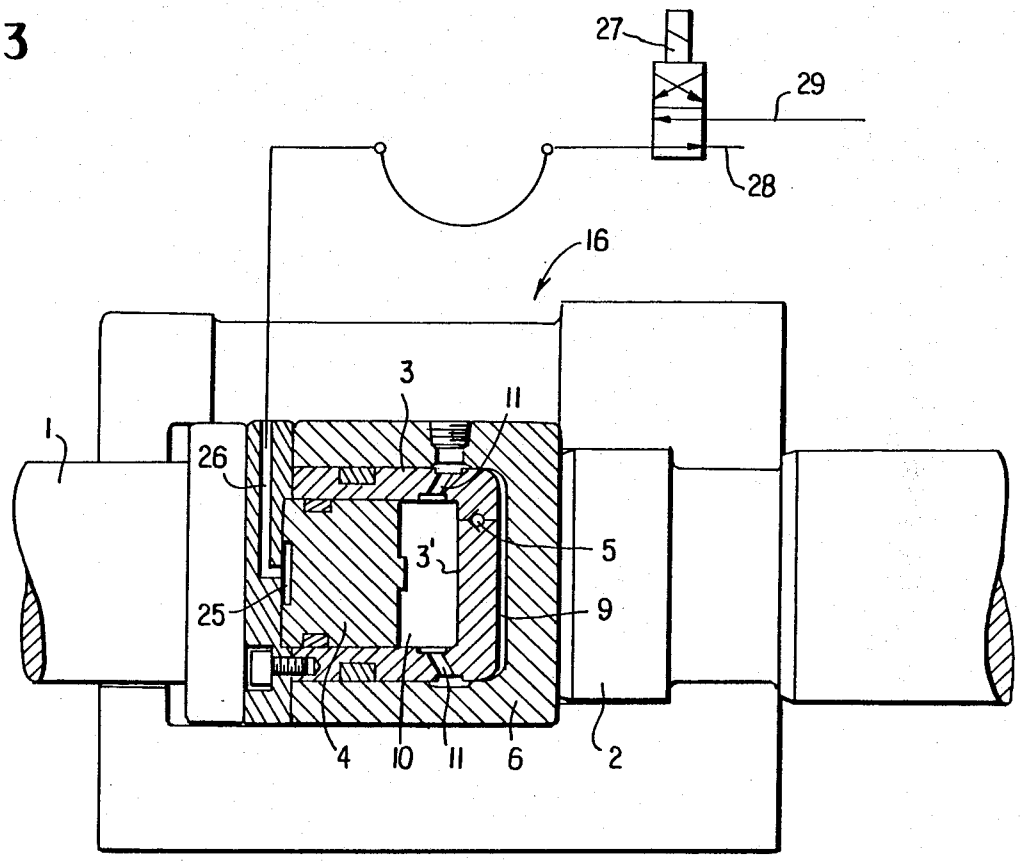
FIG. 3 is a view similar to FIG. 2, depicting the preferred embodiment at the end of the die filling phase after damping.

FIG. 3 shows the damping 16 device after the damping has been completed. The hydraulic oil displaced from damping chamber 9 is now in reservoir chamber 10 after having passed through control ports 11. During retraction of drive piston rod 2, the force is reduced to casting piston rod 1. Actuation of control valve 27 causes chamber 25 to be charged with pressure by way of pressure conduit 29 and connecting port 26. The hydraulic oil disposed in reservoir chamber 10 is now driven by the control piston 4 through check valve 5 into damping chamber 9. This forces the damping piston 3 and the housing 6 apart until control piston 4 lies against the base 3' of the damping piston 3 and the control ports 11 are closed by the land of the control piston 4. After a certain time, control valve 27 is switched back into its basic position, and the chamber 25 is again connected with the atmosphere. In this state the damping device 16 is back in its basic position, as illustrated in FIG. 2.

It will be understood that the above description of the present invention is susceptible to various modifications, changes and adaptations, and the same are intended to be comprehended within the meaning and range of equivalents of the appended claims.

I claim:

1. In a method of die-casting, including the steps of charging a die with metal by a casting piston propelled by a drive piston;

generating a pressure peak in said die by the casting piston as the die is filled up with the metal;

effecting a sudden deceleration of said casting piston by said pressure peak;

effecting a relative motion of the drive piston towards the casting piston upon said sudden deceleration; and damping said relative motion by a damping device by allowing a component rigidly connected to one of said pistons to displace a hydraulic medium through a control port;

urging a control member into a control port closing position by a closing force;

the improvement comprising the step of reducing the closing force for the duration of charging and the sudden deceleration for allowing said control member to move into a control port opening position by inertia without resistance by said closing force prevailing prior to the reducing step.

2. A method as defined in claim 1, further comprising the steps of generating a fluid pressure by pressurizing a fluid and deriving said closing force from said fluid pressure.

3. A method as defined in claim 2, wherein said reducing step comprises the step of removing the fluid pressure by allowing the fluid to communicate with the atmosphere.

4. In a damping device connecting a drive member to a driven member to provide for a braked motion of the drive member towards the driven member upon sudden deceleration of the driven member; including a damping cylinder affixed to one of said members;

a hollow damping piston affixed to the other of said members and slidably received in said damping cylinder;

a first chamber defined by said damping cylinder and being bounded by an end face of said damping piston;

a control port passing through a wall of said hollow damping piston and being in communication with said first chamber;

a control piston slidably received in said hollow damping piston; said control piston having a land arranged to cover or uncover said control port dependent upon positions of said control piston within said hollow damping piston; said control piston having opposite first and second end faces; and a second chamber defined by and in said hollow damping piston and being bounded by said first end face of said control piston;

the improvement comprising (a) a third chamber defined by said hollow damping piston and being bounded by said second end face of said control piston;

(b) a fluid conduit communicating with said third chamber; and (c) switch valve means connected to said fluid conduit for selectively introducing fluid under pressure into said third chamber to displace said control piston into a position in which said land covers said control port, and for selectively depressurizing said third chamber for allowing said control piston to move, in response to said deceleration, by inertia without substantial resistance into a position in which said land uncovers said control port to permit said damping piston to move into said damping cylinder by displacing hydraulic fluid from said first chamber through said control port into said second chamber.

5. A damping device as defined in claim 9, in combination with a die-casting machine including (a) a die;

(b) a casting cylinder extending into said die;

(c) a casting piston slidably received in said casting cylinder;

(d) a casting piston rod attached to said casting piston and constituting said driven member; and (e) a drive means for exerting a driving force on said casting piston, said drive means including a drive rod constituting said drive member.

* * * * *